US007871160B2

(12) United States Patent
Kang et al.

(10) Patent No.: US 7,871,160 B2
(45) Date of Patent: Jan. 18, 2011

(54) INK CIRCULATION APPARATUS AND INKJET PRINTER INCLUDING THE SAME

(75) Inventors: Sung-wook Kang, Seoul (KR); Kazuo Haida, Seongnam-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 957 days.

(21) Appl. No.: 11/696,957

(22) Filed: Apr. 5, 2007

(65) Prior Publication Data

US 2008/0007604 A1 Jan. 10, 2008

(30) Foreign Application Priority Data

Jul. 4, 2006 (KR) ..... 10-2006-0062613

(51) Int. Cl.
*B41J 2/18* (2006.01)
*B41J 2/175* (2006.01)

(52) U.S. Cl. ..... 347/89; 347/93

(58) Field of Classification Search ..... 347/84–87, 347/93, 89

See application file for complete search history.

(56) References Cited

U.S. PATENT DOCUMENTS 5,296,875 A 3/1994 Suda
7,040,745 B2 * 5/2006 Kent ..... 347/89
2004/0085416 A1 5/2004 Kent

FOREIGN PATENT DOCUMENTS

| | | |
|---|---|---|
| EP | 1403059 | 3/2004 |
| JP | 10-129008 | 5/1998 |
| JP | 2004-351641 | 12/2004 |
| JP | 2005-144954 | 6/2005 |

OTHER PUBLICATIONS

European Search Report dated Oct. 5, 2007 issued in EP 07108673.0.

* cited by examiner

*Primary Examiner*—An H Do
(74) *Attorney, Agent, or Firm*—Stanzione & Kim LLP

(57) ABSTRACT

An inkjet printer includes an ink tank to store ink, an auxiliary tank having an ink chamber through which the ink circulates with the ink tank, a head having nozzles which communicate with the ink chamber and eject ink therethrough, a filter which is positioned inside the auxiliary tank and divides the ink chamber into a first ink chamber which communicates with the ink tank and a second ink chamber which communicates with the nozzles, a circulation pipe which connects the ink tank with the first ink chamber and forms a circulation flow route, and a pump which is positioned on the circulation flow route to apply a negative pressure to the auxiliary tank.

13 Claims, 3 Drawing Sheets

INK CIRCULATION APPARATUS AND INKJET PRINTER INCLUDING THE SAME

CROSS-REFERENCE TO RELATED APPLICATIONS

This application claims priority under 35 U.S.C. §119(a) from Korean Patent Application No. 2006-0062613 filed on, Jul. 4, 2006, in the Korean Intellectual Property Office, the disclosure of which is incorporated herein in its entirety by reference.

BACKGROUND OF THE INVENTION

1. Field of the Invention

The present general inventive concept relates to an ink circulation apparatus and an inkjet printer including the same, and more particularly, to an ink circulation apparatus which does not discharge ink during an ink circulation process and has an efficient ink circulation flow route, and an inkjet printer including the same.

2. Description of the Related Art

Generally, an inkjet printer deposits ink on a printing paper through nozzles provided in a head to form a predetermined image on the printing paper. However, in the case that the nozzles are blocked by foreign substances, such as, minute dust or bubbles, an image cannot be formed on a part of the printing paper corresponding to the blocked nozzles. Thus, a filter is generally provided on an ink flow route between an ink tank which stores ink and the nozzles to filter the bubbles and/or the foreign substances.

In the case of an ink jet printer having a difficulty in replacing a head because the head is fixed on a printer housing, there is a need for an ink circulation process for recovering bubbles and foreign substances from the ink flow route between the nozzles and the ink tank into the ink tank so as to prevent the nozzles from being blocked.

As illustrated with a solid line arrow 40 in FIG. 1, a conventional inkjet printer 1 has an ink circulation process in which the ink is circulated via an ink tank 10, a negative pressure part 50, a head assembly 20, and a circulation pump 30 in sequence by an operation of the circulation pump 30. The negative pressure part 50 applies a negative pressure to the head assembly 20 to prevent the ink from being discharged through nozzles of the head assembly 20 during the ink circulation process. Here, the filter (not illustrated) is positioned on the ink circulation flow route inside the negative pressure part 50 to filter the foreign substances.

In the conventional inkjet printer 1, the filter is positioned on the ink circulation flow route, so that the circulation pump 30 should have a large capacity to overcome a flow resistance owing to the filter.

Further, the conventional inkjet printer 1 is inefficient because it circulates the ink through all the head assembly 20, the negative pressure part 50, and the filter. Because the foreign substances and the bubbles in the head assembly 20 ahead of the filter are filtered by the filter, the head assembly 20 contains relatively clean ink having less foreign substances and less bubbles in comparison with the ink in other areas.

Also, an ink circulation process by a positive pressure pump has been disclosed in Japanese First Patent Publication No. 2004-351641, which is designed to minimize the amount of ink wastefully discharged through the nozzles in an ink circulation process.

SUMMARY OF THE INVENTION

The present general inventive concept provides an ink circulation apparatus which has an efficient ink circulation process and does not discharge ink through the nozzles during an ink circulation process, and an inkjet printer including the same.

Additional aspects and advantages of the present general inventive concept will be set forth in part in the description which follows and, in part, will be obvious from the description, or may be learned by practice of the present general inventive concept.

The foregoing and/or other aspects and utilities of the present general inventive concept are achieved by providing an inkjet printer, comprising an ink tank to store ink, an auxiliary tank having an ink chamber through which the ink circulates with the ink tank, a head having nozzles which communicate with the ink chamber and eject ink therethrough, a filter which is positioned inside the auxiliary tank and divides the ink chamber into a first ink chamber which communicates with the ink tank and a second ink chamber which communicates with the nozzles, a circulation pipe which connects the ink tank with the first ink chamber and forms a circulation flow route, and a pump which is positioned on the circulation flow route to apply a negative pressure to the auxiliary tank.

The pump may pump the ink in the ink chamber to the ink tank.

The negative pressure of the pump may be within a predetermined range to maintain an ink meniscus formed on an inside wall of the nozzles.

The filter may be positioned paralleling a direction of the ink flow route formed in the first ink chamber.

The filter may be positioned adjacent to the head.

The ink tank may comprise an inlet and an outlet, and the first ink chamber may comprise an auxiliary tank inlet connected with the outlet of the ink tank and an auxiliary tank outlet connected with the inlet of the ink tank.

The auxiliary tank may be positioned between the auxiliary tank inlet and the auxiliary tank outlet, and further comprises a compartment plate to divide the ink chamber to form an ink flow route.

The inkjet printer may further comprise a valve which is positioned on the circulation flow route to control a flow amount of the ink passing through the circulation pipe.

The foregoing and/or other aspects and utilities of the present general inventive concept are also achieved by providing an ink circulation apparatus of an inkjet printer, comprising an ink tank to store ink, an auxiliary tank having an ink chamber through which the ink circulates with the ink tank, a head having nozzles which communicate with the ink chamber and eject ink therethrough, a filter which is positioned inside the auxiliary tank, and divides the ink chamber into a first ink chamber which communicates with the ink tank and a second ink chamber which communicates with the nozzles, a circulation pipe which connects the ink tank with the first ink chamber and forms a circulation flow route, and a pump which is positioned on the circulation flow route to apply a negative pressure to the auxiliary tank.

The pump may pump the ink in the first ink chamber to the ink tank.

The negative pressure of the pump may be within a predetermined range to maintain an ink meniscus on the inside wall of the nozzles.

The filter may be positioned paralleling a direction of the ink flow route formed in the first ink chamber.

The ink tank may comprise an inlet and an outlet, and the first ink chamber may comprise an auxiliary tank inlet connected with the outlet of the ink tank and an auxiliary tank outlet connected with the inlet of the ink tank.

The auxiliary tank may be positioned between the auxiliary tank inlet and the auxiliary tank outlet, and may further comprise a compartment plate to divide the first ink chamber to form an ink flow route.

The ink circulation apparatus may further comprise a valve which is positioned on the circulation flow route to control a flow amount of the ink passing through the circulation pipe.

The foregoing and/or other aspects and utilities of the present general inventive concept are achieved by providing an inkjet printer, comprising an ink cartridge having an ink tank body, a filter disposed to divide an inside of the ink tank body into a first ink chamber and a second ink chamber, a head having nozzles and disposed on a bottom of the ink tank body to receive ink from the second ink chamber, an inlet and an outlet formed on a side of the ink tank body corresponding to the first ink chamber to receive and discharge the ink, and a compartment plate disposed between the inlet and the outlet.

The compartment plate may be parallel to the filter and the head.

The compartment plate may be extended from the side of the ink tank body toward an opposite side of the ink tank body.

The compartment plate may form a hole with the opposite side such that the ink flows from the inlet to the outlet through the hole.

The inlet may be formed above the compartment plate, and the outlet may be formed below the compartment plate.

The inkjet printer may further comprise a first pipe connected to the inlet and extended below the ink tank body, and a second pipe connected to the outlet and extended below the ink tank body and the first pipe.

The inkjet printer may further comprise a pump connected to one of the first pipe and the second pipe.

The inkjet printer may further comprise a controller to control the pump by controlling a voltage to be supplied to the pump according to a mode.

The inkjet printer may further comprise another ink tank body connected to the ink tank body through the inlet and the outlet, and containing the ink of which level is lower than the nozzles of the head of the ink cartridge.

The another ink tank body may comprise another inlet and another outlet to be connected to the outlet and the inlet of the ink cartridge, respectively, and the another inlet and the another outlet may be disposed lower than the nozzles.

The foregoing and/or other aspects and utilities of the present general inventive concept are achieved by providing an inkjet printer comprising an ink cartridge having a filter to divide an inside of the ink cartridge into a first chamber and a second chamber, a head with nozzles disposed in the second chamber, and an inlet and an outlet disposed in the first chamber to form a circulation flow route of ink between the inlet and the outlet such that the circulation flow route of the ink does not go through the head and the filter.

The circulation flow route of the ink may be formed within the first chamber.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
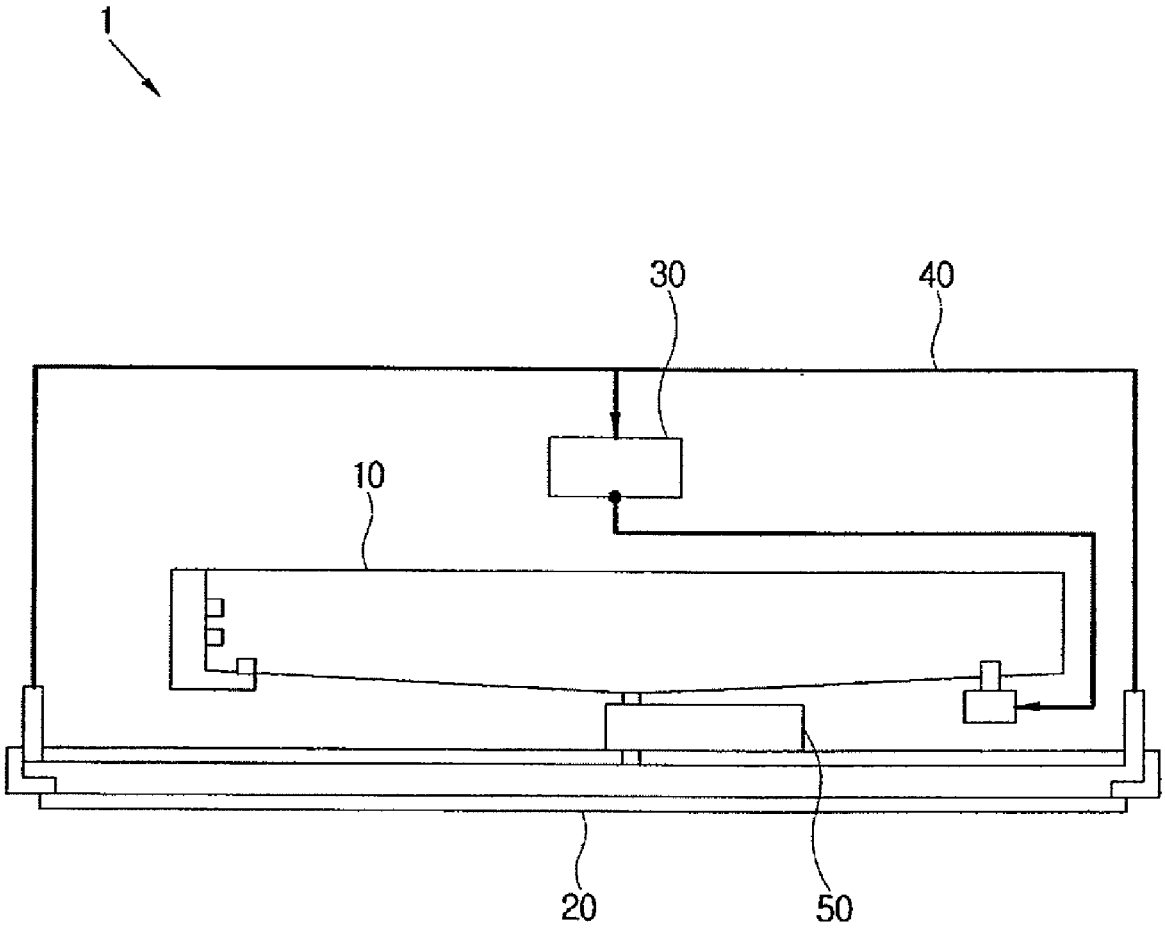
FIG. 1 (PRIOR ART)
FIG. 1 is a schematic view illustrating an ink circulation process of a conventional inkjet printer.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
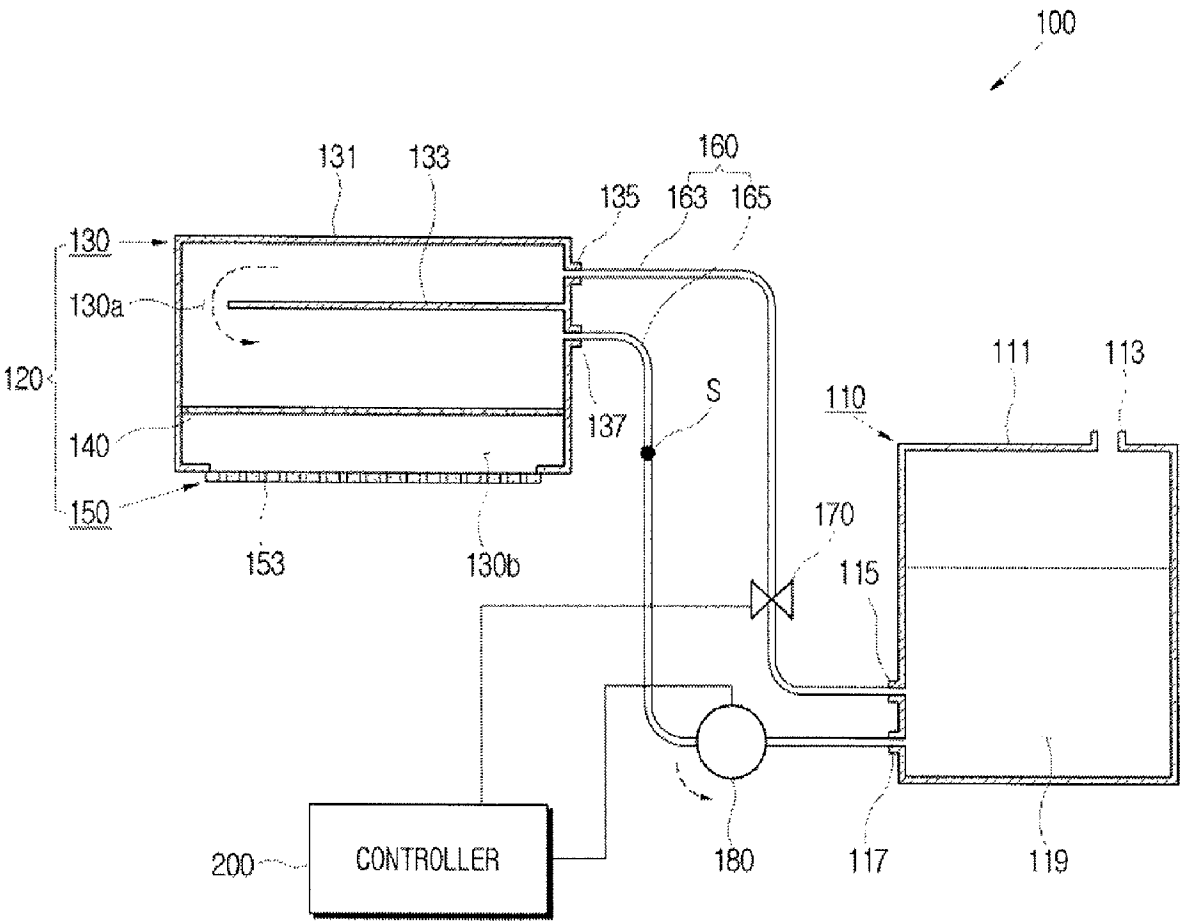
FIG. 2 is a sectional view illustrating an ink circulation apparatus of an inkjet printer according to an embodiment of the present general inventive concept.

As illustrated in FIG. 2, an inkjet printer 100 may comprise an ink tank 110 to store ink, an ink cartridge 120 which is supplied with ink from the ink tank 110 and ejects ink onto a printing paper to form an image on the printing paper, a circulation pipe 160 to connect the ink cartridge 120 with the ink tank 110 to form a circulation flow route, and a pump 180 positioned on a circulation flow route to apply a negative pressure to the ink cartridge 120.

The ink tank 110 in FIG. 2 may comprise an ink tank body 111 which forms an outer appearance and defines an ink chamber 119 to store ink, an air pipe 113 which allows atmospheric pressure to be applied to the inside of the ink tank 110, and an outlet 115 and an inlet 117 which are connected with an auxiliary tank 130 of the ink cartridge 120 (to be described later) to form the circulation flow route.

The outlet 115 and the inlet 117 may have a projected shape so as to be easily coupled to the circulation pipe 160 which will be described later. However, the present general inventive concept is not limited thereto, and the outlet 115 and the inlet 117 may also have various shapes to be coupled to the circulation pipe 160.

The ink tank 110 may be provided detachably in a printer housing (not illustrated) so that the ink tank 110 can be easily refilled with ink or replaced with a new ink tank in the case that the stored ink is used up.

The ink tank 110 may further comprise a level sensor to sense the amount of stored ink so that a user can recognize a replacing time, etc., for the ink tank 110.

The ink cartridge 120 may comprise the auxiliary tank 130 in which ink chambers 130*a* and 130*b* to guide ink inflowed from the ink tank 110 to nozzles 153 are formed, a filter 140 which divides the ink chambers 130*a* and 130*b* into a first ink chamber 130*a* which communicates with the ink tank 110 and a second ink chamber 130*b* which communicates with the nozzles 153, and a head 150 in which the nozzles 153 to eject ink onto the printing paper are formed.

The auxiliary tank 130 may comprise an auxiliary tank body 131 in which the ink chambers 130*a* and 130*b* to guide ink supplied from the ink tank 110 to the nozzles 153 are formed, a compartment plate 133 accommodated in the auxiliary tank body 131 to divide the ink chambers 130*a* and 130*b*, and an auxiliary tank inlet 135 and an auxiliary tank outlet 137 connected with the ink tank 110. The compartment plate 133 may divide the ink chamber 130*a*.

The auxiliary tank 130 may be integrally formed of a plastic material. Alternatively, the auxiliary tank 130 may be assembled by coupling the first ink chamber 130*a* and the second ink chamber 130*b*.

The ink chambers 130*a* and 130*b* are divided into the first ink chamber 130*a* and the second ink chamber 130*b* by the filter 140 which will be described later.

The first ink chamber 130*a* is connected with the ink tank 110 so as to circulate ink therebetween. The compartment plate 133 can be provided between the auxiliary tank inlet 135 and the auxiliary tank outlet 137 in the first ink chamber 130*a* so that ink can circulate through the whole area of the first ink chamber 130*a*.

As illustrated in FIG. 2, the compartment plate 133 can be positioned between the auxiliary tank inlet 135, through which ink from the ink tank 110 flows into, and the auxiliary tank outlet 137 from which ink of the first ink chamber 130*a* outflows during the ink circulation process. One side of the compartment plate 133 may be coupled to the auxiliary tank body 131 and the other side may be opened to form an ink flow route inside the first ink chamber 130*a*. The compartment plate 133 may extend from a side of the auxiliary tank body 131 on which the auxiliary tank inlet and outlet 135 and 137 are formed, toward an opposite side of the auxiliary tank body 131. Alternatively, both sides of the compartment plate 133 may be coupled to the auxiliary tank body 131 and a through hole (not illustrated) may be formed in one side area thereof.

The compartment plate 133 may be provided in parallel with the filter 140 so that ink inflowed through the auxiliary tank inlet 135 does not directly pass through the filter 140 during the ink circulation process.

The second ink chamber 130*b* stores the ink from the first ink chamber 130*a*, which has passed through the filter 140, and supplies the ink to the nozzles 153. Accordingly, relatively clean ink remains in the second ink chamber 130*b* because bubbles and/or foreign substances are filtered by the filter 140.

As illustrated in FIG. 2, the auxiliary tank inlet 135 can be positioned in an upper area of the first ink chamber 130*a*. However, the position of the auxiliary tank inlet 135 is not limited thereto, and may be positioned wherever ink can flow into the first ink chamber 130*a*. The auxiliary tank inlet 135 is connected with the outlet 115 of the ink tank 110 by the circulation pipe 160. Further, the auxiliary tank inlet 135 may have a projected shape from the auxiliary tank body 131 so as to be easily connected with the circulation pipe 160.

The auxiliary tank outlet 137 can be positioned in a lower area so that ink flowing into the first ink chamber 130*a* can smoothly outflow into the inlet 117 of the ink tank 110. The auxiliary tank outlet 137 can be connected with the inlet 117 of the ink tank 110 by the circulation pipe 160. Also, the auxiliary tank outlet 137 can have a projected shape from the auxiliary tank body 131 so as to be easily connected with the circulation pipe 160.

As illustrated in FIG. 2, the filter 140 is accommodated inside the auxiliary tank 130 and divides the ink chambers 130*a* and 130*b* into the first ink chamber 130*a* connected with the ink tank 110 and the second ink chamber 130*b* connected with the nozzles 153.

The filter 140 can be positioned so that ink circulating the first ink chamber 130*a* can receive the least flow resistance owing to the filter 140, for example, a direction paralleling the ink circulation flow route, and/or a direction paralleling the compartment plate 133 and the head 150, as illustrated in FIG. 2. Accordingly, the filter 140 is not positioned on the circulation flow route between the ink tank 110 and the first ink chamber 130*a*, and thus the pump 180 can have a small capacity. Alternatively, the filter 140 may be inclined as necessary while positioned on the ink circulation flow route as long as a meniscus of ink formed in the nozzles 153 is not destroyed.

The filter 140 can be positioned adjacent to the head 150. Accordingly, some area of the second ink chamber 130*b*, including the filter 140, can be coupled with the head 150 in a semiconductor clean room to prevent foreign substances or bubbles from flowing into the head 150 during the manufacturing process of the ink cartridge 120, and the other components can be assembled in an area other than the semiconductor clean room to manufacture the ink cartridge 120. Accordingly, a manufacturing cost can be lowered by reducing an equipment cost to maintain a clean room.

The filter 140 can be a plate in which minute holes (not illustrated) are formed along a surface of the plate. The plate may be a silicon wafer, a plastic plate, or a metal plate, which can be processed to have the minute holes. The size of the minute hole can be smaller than the diameter of the nozzles to completely filter the foreign substances or the bubbles. Alternatively, the size of the minute holes may be equal to or larger than the nozzle diameter in consideration of a use condition.

The head 150 may comprise the nozzles 153 to eject ink onto the printing paper, an ink chamber in which a minute thin-film ink flow route can be formed above the nozzles 153, and a heating resistance body (not illustrated), as an example of an ink ejecting body, positioned inside the ink chamber and heating the ink. The head 150 can be manufactured in the shape of a chip through a semiconductor process. Meanwhile, the head 150 may be provided as a page-width array-type print head in which a plurality of nozzles 153 are positioned in a predetermined pattern.

As illustrated in FIG. 2, a water head (ink level) of the head 150 can be larger, by a predetermined range of 20~60 mmAq, than that of the ink tank 110. That is, the bottom of the head 150 can be positioned at a higher level than the level of the ink stored in the ink tank 110. This level difference prevents the ink from being discharged at the atmospheric pressure through the nozzles 153 even though the pump 180 may not operate in a print standby state. Further, the range of the level difference may be properly determined in consideration of the volumes of the ink tank 110 and the auxiliary tank 130 or the size of the head 150.

As illustrated in FIG. 2, the circulation pipe 160 may comprise an upper pipe 163 to connect the outlet 115 of the ink tank 110 with the auxiliary tank inlet 135, and a lower pipe 165 to connect the inlet 117 of the ink tank 110 with the auxiliary tank outlet 137.

The circulation pipe 160 may be formed of a soft plastic material to have elasticity.

The upper pipe 163 can be clamp-coupled to be easily coupled to and separated from the outlet 115 of the ink tank 110 and the auxiliary tank inlet 135. Alternatively, a projection (not illustrated) may be provided in opposite ends of the upper pipe 163 and a groove (not illustrated) may be provided in each side of the outlet 115 and the auxiliary tank inlet 135, so that the projection and the groove are coupled each other. However, the present general inventive concept is not limited thereto, and the upper pipe 163 may be coupled to the outlet 115 of the ink tank 110 and the auxiliary tank inlet 135 by other known coupling methods.

The lower pipe 165 can be coupled to the inlet 117 of the ink tank 110 and the auxiliary tank outlet 137 by the same coupling methods as the upper pipe 163.

As illustrated in FIG. 2, a valve 170 can be provided on the upper pipe 163 to control a flow amount of the ink passing through the upper pipe 163. Alternatively, the valve 170 may be provided on the lower pipe 165 as necessary. The valve 170 can be one of a check valve, a solenoid valve, or an electronic expansion valve, and may be a combination of two or more valves as necessary.

The pump 180 is provided on the route of the lower pipe 165. Alternatively, the pump 180 may be provided in the upper pipe 163 instead of the lower pipe 165 as necessary.

The pump 180 can be a rotary pump operated by a motor (not illustrated), or a diaphragm pump when considering space efficiency. However, the pump 180 is not limited to the above-described pumps, and may employ various types of pumps to apply a negative pressure to the first ink chamber 130*a*. Also, the pump 180 may be operated in the printing process as necessary, but when considering energy efficiency, the pump 180 may operate only to remove foreign substances or bubbles.

The pump 180 applies a negative pressure to the first ink chamber 130*a* of the auxiliary tank 130 in the ink circulation process. The negative pressure is generated when the pump 180 pumps the ink in the first ink chamber 130*a* through the auxiliary tank outlet 137 into the inlet 117. When the negative pressure is applied to the first ink chamber 130*a*, the ink in the ink tank 110 flows into the first ink chamber 130*a* through the auxiliary tank inlet 135. Accordingly, an anticlockwise ink circulation flow route is formed between the first ink chamber 130*a* and the ink tank 110 as illustrated in FIG. 2. On the other hand, a clockwise circulation flow route can be formed in the case that the pump 180 is positioned in the upper pipe 163.

The negative pressure generated in the first ink chamber 130*a* causes negative pressure to be generated in the second ink chamber 130*b* communicated with the first ink chamber 130*a* across the filter 140. As the pressure of the second ink chamber 130*b* lowers, the ink in the nozzles 153 communicated with the second ink chamber 130*b* is pressed toward the second ink chamber 130*b*. Accordingly, the ink can be prevented from being discharged to an outside of the head 150 (see the lower side of the nozzles 153 in FIG. 2) through the nozzles 153 during the ink circulation process.

Accordingly, an extra waste ink vessel in front of the head is not needed to collect the ink discharged during the ink circulation process, and an extra pump is not needed to move the ink from the waste ink vessel to the ink tank.

However, in the case that an excessively low negative pressure (having a negative value and a large absolute value) is applied to the first ink chamber 130*a* by the pump 180, a meniscus of ink which has been formed inside the nozzles may be destroyed and outside air flow in through the nozzles. Accordingly, the pump 180 may apply the negative pressure within a predetermined range to prevent the meniscus of the nozzle ink from being destroyed.

The range of the negative pressure can be properly determined by an experiment, and a determination method will be described as follows.

First, a correlation between the pumping flow amount of the pump 180 or a voltage applied to the operating motor of the pump 180 and a negative pressure measured at a measurement point or positions are obtained by an experiment. The measurement points indicate random positions on the ink circulation flow route between the ink tank 110 and the first ink chamber 130*a*. As illustrated in FIG. 2, the measurement point S adjacent to the auxiliary tank outlet 137 on the lower pipe 165 may be used as the measurement point.

Figure 3:
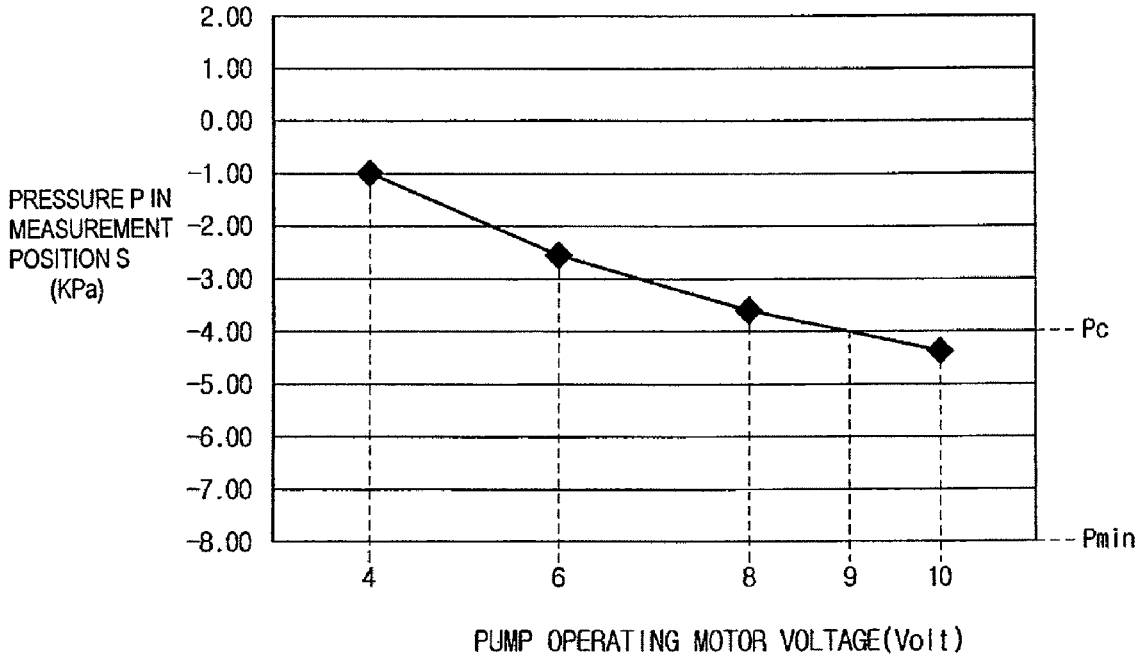
FIG. 3 is a graph illustrating a correlation between a pressure at a measurement point S on an ink circulation flow route of the ink jet printer illustrated in FIG. 2 and a voltage of a pump operating motor.

An ink pressure at the measurement point can measured by installing a pressure sensor at the measurement point S illustrated in FIG. 2, and by increasing the voltage applied to the operating motor of the pump 180, and thus, a graph like the one illustrated in FIG. 3 can be obtained by expressing the measured values on rectangular coordinates.

Also, through the experiment, the lowest negative pressure (Pmin in FIG. 3) at the measurement point S can be measured when the ink meniscus formed in the nozzles begins to be destroyed. In FIG. 3, for example, the lowest negative pressure Pmin at the measurement point S indicates a pressure of −8 KPa as when the meniscus is destroyed.

In theory, a predetermined margin may be added to the measured lowest pressure (Pmin) in consideration of experimental error though the ink meniscus of the nozzles 153 is maintained when the pump 180 generates a higher negative pressure than the lowest negative pressure Pmin at the measurement point S. That is, the pump 180 may apply the negative pressure to the auxiliary tank 130 so that a pressure over a critical pressure Pc, in which a margin is added to the lowest pressure Pmin, can be generated at the measurement point S.

Taking an example, as illustrated in FIG. 3, a value −4 Kpa, which is obtained by adding a margin of +4 KPa to the lowest negative pressure Pmin measured of −8 Kpa, may be used as a critical negative pressure Pc. In this exemplary case, an upper limit of the voltage applied to the operating motor of the pump 180 indicates a pump operating motor voltage value corresponding to the critical negative pressure Pc −4 KPa in FIG. 3, which, in this case, indicates around 9V and the pumping flow amount of the pump 180 indicates 8.4 cc/min.

However, in the case that an excessively high negative pressure (having a negative value and an absolute value near zero) is applied to the first ink chamber 130*a* by the pump 180, the ink may not smoothly circulate because of a friction with the circulation pipe 160. Accordingly, the pump 180 can be set to an upper limit of the negative pressure at the measurement point S in consideration of a minimum ink circulation speed or a maximum ink circulation time. For example, in the case that a maximum negative pressure value is set as −1 KPa, a voltage over 4V should be applied to the operating motor of the pump 180.

In other words, a voltage within a predetermined range may be applied to the operating motor so that the pump 180 generates a negative pressure measured at the measurement point S that can be over the critical negative pressure Pc and under the upper limit of the negative pressure. Accordingly, the negative pressure within a predetermined range is applied to the first ink chamber 130*a*. In the above-described exemplary case illustrated in FIG. 3, the power is applied to the operating motor of the pump 180 within the range of 4V to 9V corresponding to the upper limit of the negative pressure (−1 KPa) and the critical negative pressure (Pc −4 KPa), at a measurement position S of the lower pipe 165. This enables the negative pressure within a predetermined range to be applied to the first ink chamber 130*a* by installing a pressure sensor (not illustrated) and controlling revolutions per minute (RPM) of the operating motor of the pump 180 according to the pressure value measured by the pressure sensor. That is, the RPM of the operating motor can be controlled to increase in the case that the measured pressure is low, and the RPM of the operating motor can be controlled to decrease in the case that the measured pressure is high.

The pump 180 may be provided to select one optimum negative pressure value within the above-described predetermined range of negative pressures, and to generate only the selected negative pressure. At this time, the pressure sensor (not illustrated) does not need to be installed at the measurement point S, and the pump 180 may be provided so that a regular negative pressure can be generated in the first ink chamber 130*a* by turning on or off the operating motor of the pump 180 having a predetermined pumping amount when power is applied.

The pump 180 may pump a large amount of ink so as to remove the foreign substances and the bubbles quickly during the ink circulation process. Accordingly, the operating motor of the pump 180 can be set to receive a voltage corresponding to the critical negative pressure Pc so as to perform a cleaning process in a short time, as long as the ink meniscus is not destroyed. For example, under the conditions illustrated in FIG. 3, when a voltage of 9V is applied to the operating motor of the pump 180, it takes minimum time to perform the cleaning.

The pump 180 may apply a positive pressure to the first ink chamber 130*a* of the auxiliary tank 130 for a purging process which will be described later. That is, the operating motor of the pump 180 can rotate in forward and reverse directions to apply a positive pressure to the auxiliary tank 130 in the purging process and to apply a negative pressure to the auxiliary tank 130 in the ink circulation process.

The inkjet printer 100 according to the present general inventive concept may further comprise a controller 200 to control the opening/closing of the valve 170 and an operation of the pump 180.

The controller 200 controls the valve 170 and the pump 180 to perform the ink circulation process to remove foreign substances and bubbles from the ink circulation flow route and the purging process to remove the foreign substances and the bubbles from the head 150 according to a predetermined condition or circumstance. That is, for example, the controller 200 can perform the ink circulation process or the purging process regularly or irregularly at a user's request. Additionally, the purging process may be omitted and only the ink circulation process may be performed as necessary. The controller 200 may control the voltage power of a source to be supplied to the pump 180 and to the valve 170.

In the case that the ink circulation process is performed, the controller 200 opens the valve 170 and operates the pump 180 to pump the ink from the auxiliary tank outlet 137 to the inlet 117. Accordingly, the ink is circulated between the first ink chamber 130*a* and the ink tank 110. Further, the foreign substances and the bubbles on the ink circulation flow route are recovered into the ink tank 110, and the recovered bubbles can ascend by a buoyant force in the ink chamber 119 of the ink tank 110 and then may be removed.

In the case that the purging process is performed, the controller 200 closes the valve 170 and operates the pump 180 so that ink can be pumped from the inlet 117 to the auxiliary tank outlet 137. That is, the controller 200 can reverse the ink pumping direction during the purging process by rotating the operating motor of the pump 180 in a reverse direction to the rotating direction of the operating motor in the ink circulation process. Accordingly, the ink circulation is blocked and the ink is discharged to the outside of the head 150 through the nozzles 153, thereby removing the foreign substances and the bubbles from the head 150 and the second ink chamber 130*b*.

The operating process of the ink jet printer 100 with this configuration will be described hereinafter.

The controller 200 of the inkjet printer 100 can perform the purging process to clean the head 150 and the second ink chamber 130*b* before starting printing according to a user's printing command. That is, the controller 200 closes the valve 170 and supplies power to the operating motor of the pump 180 to apply positive pressure to the auxiliary tank 130. Accordingly, the bubbles or the foreign substances are discharged with ink, and the head 150 and the second ink chamber 130*b* are cleaned.

The controller 200 opens the valve 170 after the purging process and stops the operation of the pump 180. Thereafter, a printing operation may be performed, for example, an electric current flows into the heating resistance body to apply heat to the ink in the ink chamber, ink bubbles are formed by the heat, and the ink is ejected through the nozzles 153 by an expansion force of the bubbles, to thereby form a predetermined image on a printing paper. Alternatively, the ink may be ejected through the nozzles by a pressure force generated from the deformation of a piezo-electric body in the case of a piezo-electric type ink-jet printer.

The ink, as much as the amount of ink ejected through the nozzles 153 and consumed, can be supplied from the ink tank 110 to the auxiliary tank 130 by a capillary phenomenon during the printing. After the printing is completed, the purging process can be again performed to clean the head 150 and the second ink chamber 130*b*, and to prepare the ink jet printer 100 for a user's command.

Further, the controller 200 can check whether the valve 170 is open or closed prior to when the ink circulation process is needed, and can open the valve 170 in the case that the valve 170 is closed. After that, the controller 200 can operate the pump 180 and can apply the negative pressure to the auxiliary tank 130 to circulate the ink between the first ink chamber 130*a* and the ink tank 110. Accordingly, the foreign substances and the bubbles can be recovered from the first ink chamber 130*a* and the ink tank 110 to the ink tank 110 and then removed.

While, a bubble-jet type method to eject ink of an inkjet printer has been describes as the method to eject ink, the present general inventive is not limited thereto, and the ink circulation method may be applied to other inkjet printers, such as, a piezo-electric type inkjet printer.

As described above, an ink circulation apparatus and an inkjet printer having the same according to the present general inventive concept have the following effects.

First, it is more efficient to have a circulation flow route between the ink tank 110 and the first ink chamber 130*a* not directly going through the head 150 and the filter 140 than a whole circulating system.

Second, ink is not ejected through the nozzles 153 in the ink circulating process because the pump 180 applies the negative pressure. Accordingly, extra apparatuses to store the ejected ink are not needed. Also, the ink circulating apparatus is more economical because the ink is not ejected in the ink circulating process and can be used for a long time.

Third, ink can be circulated with the small capacity of pump 180 by minimizing a flow resistance by the filter 140. Accordingly, a manufacturing cost can be reduced by using the small capacity pump 180.

Fourth, as the filter 140 can be positioned adjacent to the head 150, the foreign substances are prevented from flowing into the head 150, so that a manufacturing process of the whole ink cartridge 120 does not need to be performed in the semiconductor clean room, thereby reducing an equipment cost to maintain the clean room and to lower manufacturing cost.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printer, comprising:

an ink tank to store ink, the ink tank comprising an inlet and an outlet;

an auxiliary tank having an ink chamber through which the ink circulates with the ink tank;

a head having nozzles which communicate with the ink chamber and eject ink therethrough;

a filter which is positioned inside the auxiliary tank and divides the ink chamber into a first ink chamber which communicates with the ink tank and a second ink chamber which communicates with the nozzles, the first ink chamber comprising an auxiliary tank inlet configured to be connected with the outlet of the ink tank and an auxiliary tank outlet configured to be connected with the inlet of the ink tank;

a circulation pipe which connects the ink tank with the first ink chamber and forms a circulation flow route;

a pump which is positioned on the circulation flow route to apply a negative pressure to the auxiliary tank; and a compartment plate disposed between the auxiliary tank inlet and the auxiliary tank outlet, wherein the compartment plate is arranged such that ink flowing into the first chamber through the auxiliary tank inlet first flows onto the compartment plate and then flows from the compartment plate towards the filter.

2. The inkjet printer according to claim 1, wherein the pump pumps the ink in the ink chamber to the ink tank.

3. The inkjet printer according to claim 1, wherein the negative pressure of the pump is within a predetermined range to maintain an ink meniscus formed on an inside wall of the nozzles.

4. The inkjet printer according to claim 1, wherein the filter is positioned paralleling a direction of the ink flow route formed in the first ink chamber.

5. The inkjet printer according to claim 4, wherein the filter is positioned adjacent to the head.

6. The inkjet printer according to claim 1, further comprising:

a valve which is positioned on the circulation flow route to control a flow amount of the ink passing through the circulation pipe.

7. The inkjet printer according to claim 1, wherein the compartment plate is substantially parallel to the filter.

8. An ink circulation apparatus of an inkjet printer, comprising:

an ink tank to store ink, the ink tank comprising an inlet and an outlet;

an auxiliary tank having an ink chamber through which the ink circulates with the ink tank;

a head having nozzles which communicate with the ink chamber and eject ink therethrough;

a filter which is positioned inside the auxiliary tank, and divides the ink chamber into a first ink chamber which communicates with the ink tank and a second ink chamber which communicates with the nozzles, the first ink chamber comprising an auxiliary tank inlet configured to be connected with the outlet of the ink tank and an auxiliary tank outlet configured to be connected with the inlet of the ink tank;

a circulation pipe which connects the ink tank with the first ink chamber and forms a circulation flow route;

a pump which is positioned on the circulation flow route to apply a negative pressure to the auxiliary tank; and a compartment plate disposed between the auxiliary tank inlet and the auxiliary tank outlet, wherein the compartment plate is arranged such that ink flowing into the first chamber through the auxiliary tank inlet first flows onto the compartment plate and then flows from the compartment plate towards the filter.

9. The ink circulation apparatus according to claim 8, wherein the pump pumps the ink in the first ink chamber to the ink tank.

10. The ink circulation apparatus according to claim 8, wherein the negative pressure of the pump is within a predetermined range to maintain an ink meniscus on the inside wall of the nozzles.

11. The ink circulation apparatus according to claim 8, wherein the filter is positioned paralleling a direction of the ink flow route formed in the first ink chamber.

12. The ink circulation apparatus according to claim 8, further comprising:

a valve which is positioned on the circulation flow route to control a flow amount of the ink passing through the circulation pipe.

13. The inkjet printer according to claim 8, wherein the compartment plate is substantially parallel to the filter.

* * * * *